United States Patent [19]

Wang

[11] 4,360,327

[45] Nov. 23, 1982

[54] MULTIPURPOSE, SYNCHRONOUS, THREE ANGLE-CROSS COMPRESSOR

[76] Inventor: Liang-Chih Wang, No. 21-20, Chungchin New Village, Tienhsin St., San Chung City, Taiwan

[21] Appl. No.: 142,885

[22] Filed: Apr. 23, 1980

[51] Int. Cl.[3] ..... F04C 18/00; F04C 29/00

[52] U.S. Cl. ..... 418/235; 418/245

[58] Field of Search ..... 418/235, 245

[56] References Cited

U.S. PATENT DOCUMENTS

| | | | |
|---|---|---|---|
| 224,999 | 3/1880 | De Groat | 418/245 |
| 381,287 | 4/1888 | Snevely | 418/235 |
| 711,354 | 10/1902 | Shumway | 418/245 |
| 1,044,782 | 11/1912 | Hermanns | 418/245 |
| 1,174,632 | 3/1916 | Snyder | 418/245 |
| 1,235,786 | 8/1917 | Fleming | 418/245 |
| 3,617,158 | 11/1971 | Yamamoto et al. | 418/245 |

FOREIGN PATENT DOCUMENTS

| | | | |
|---|---|---|---|
| 74152 | 4/1894 | Fed. Rep. of Germany | 418/245 |
| 1721 | of 1883 | United Kingdom | 418/245 |

*Primary Examiner*—John J. Vrablik

*Attorney, Agent, or Firm*—Watson, Cole, Grindle & Watson

[57] ABSTRACT

An epoch-making new type compressor is characterized by its sealed cylinder, the upper part gyro-cam (in S shape) of which starts slider in the cylinder (it is provided with the same shaft and in the same "S" shape with the upper gyro-cam) for forth and back coordination and engage the synchronous three angle-cross operation whereby the slider goes forth and back along the socket in the cylinder. The air goes into the compressing chamber through the inlet with the free valve beside the slider and goes out through the outlet with the reverse valve beside the other slider (in the front position of the first slider) by means of excluding by the slider attached to the wing shaft in cylinder.

3 Claims, 7 Drawing Figures

MULTIPURPOSE, SYNCHRONOUS, THREE ANGLE-CROSS COMPRESSOR

BACKGROUND AND SUMMARY OF THE INVENTION

This invention relates to the field of compressors. The traditional compressor operates with an up and down reciprocating stroke, and its power consumption and abrasion characteristics are very high. Although an improved gyro-compressor which can minimize its power consumption and abrasion has been designed, it can neither absorb the input compressed air to extremity nor transmit the input compressed air by the compressor piping in large amounts freely and systematically. How to overcome (remedy) these deficiencies are the objects of the present invention.

It is thus an object of the present invention to provide the dual functions of an exhaust fan and a compressor in one unit which can operate with a minimum power. In other words, it is characterized by its large proportional amount of exhausted compressed air with respect to the amount of input compressed air. It is another object of the present invention to provide a device to take, through the piping's exhausting and absorbing function, the place of the factory stack and treat the exhausted smoke and gas, etc., in piping based on their quality and composition chemically and physically and then filter, deheat and dehumidify them in order to let them turn into colorless, odorless and poison free clear air, and additionally the air convection current and function combustion promotion in furnace through the speed control device.

It is a still further object of the present invention to provide a innovated central air condition center unit, the exhaust stroke of which is fixed to piping and disposed concentratedly in the wall in such a way as to increase the internal space of a building room. Therefore, the present invention can be designed in construction together with the waterpipe, wire pipe and gas pipe as a whole, cross-the-boardly. The present invention acts as a multi-purpose compressor; the small size compressor comprising four sets of absorbing-exhausting strokes. The first set is connected to a room and used as the air conditioned to condition the air by means of supplying the cold or warm air into the room through filtering, de-heating or heating the air. The second set is connected to the place where the smoke exhaust is fixed as the exhauster to exhaust the smoke or oil through a filtering net. The third set is connected to a water closet and is used as the device to exhaust therefrom the odor and absorb thereto the fresh air. The fourth set is connected to dining room or bedroom to act as the electric fan. The large size compressor can freely be divided into 8, 9, 10, . . . set to be used as the central air conditioning unit for the great building or factory. The most important advantage of the present invention is to save the energy in addition to its lower production cost. Therefore, the present invention is a popular air conditioning device. It is further object of the present invention to provide by adapting, a liquid compressing pump to treat and purify, with the chemical or physical processes, the polluted waste water for the chemical factory, to serve the purpose of purifying the waste water.

DETAILED DESCRIPTION

Figure 1:
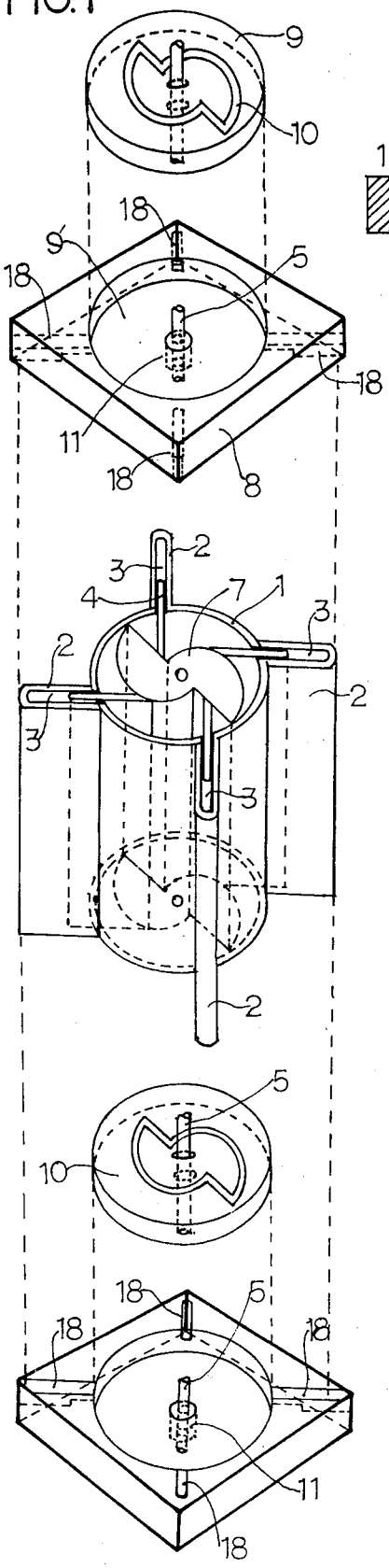
FIG. 1 shows an exploded perspective view of a compressor constructed in accordance with and embodying the present invention.

Referring now by reference numerals to the FIG. 1, this invention is the multi-purpose synchronous three-angle-cross compressor comprising two sets of upper and lower, symmetrical, fixed seal (end) plates 8 enclaved into star disc cam 9 respectively, a sealed cylinder in the unit, equipped in it with a "S" wing shaft 7, some equiangular convex plate 2 fixed around the sealed cylinder, a slider 4 fixed at the socket 3 channelling the section of convex plate 2, cylinder and its internal wall, the pulley 15 fixed on slider, some inlets 12 and outlets 13 on the wall of sealed cylinder 1 to function as the inleting and outleting devices which are the main components of the present invention.

Figure 4:
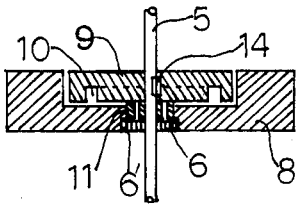
FIG. 4 is a side view illustrated in FIG. 3.
Figure 3:
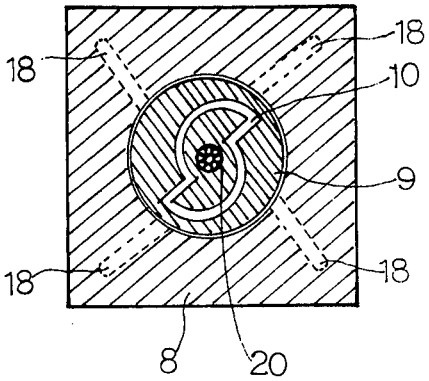
FIG. 3 is a plan view of the cam on the upper part fixed seal plate and its "S" shape socket at its bottom.
Figure 5:
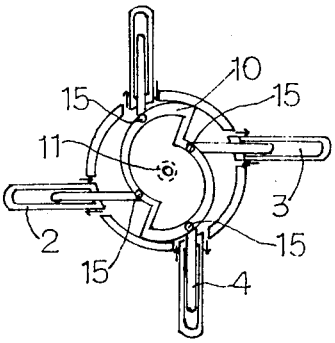
FIG. 5 is a plan view of the "S" socket enclaved on the pulley at the top of slider.
Figure 7:
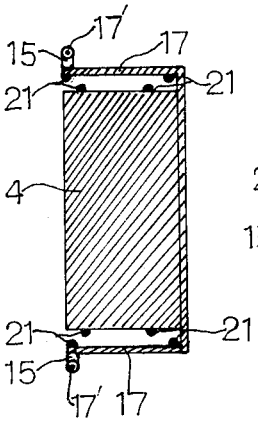
FIG. 7 shows a side view of a slider device used in the compressor of the present invention.

Referring to FIG. 3 and FIG. 4, the present invention is a compressor comprising a cover 16 completed by a cut internal circle 9' on the upper part of fixed and sealed plate 8, enclaved on star disc cam 9, a central shaft 5 at the center of the sealed plate 8, going through the whole compressor, a bearing 11 comprising the steel balls 20 and lubricant oil, fixed at the center of sealed plate 8 to make the shaft 5 operate smoothly, a convex disc 6 fixed below the bearing (a disc socket 6 in the section of bottom of sealed plate 8), which acts as a device to fix the "S" wing shaft 7 in sealed cylinder 1 with shaft rotation, prevent the air leakage from the clearance between the star disc cam 9 at the upper and lower and central position, a "S" socket 10 in the section of bottom of star disc cam 9, which can be enclaved on pulley 15 at the upper ends of slide 4 in the cylinder 1 the bottom track of which, when star disc cam 9 with shaft center rotates, will start the pulley 15, and make the slider 4 reciprocate (refer to FIG. 5) and a bolt 14 screwed which when star disc cam 9 is set in shaft 5, prevents the star cam 9 from dropping.

Figure 6:
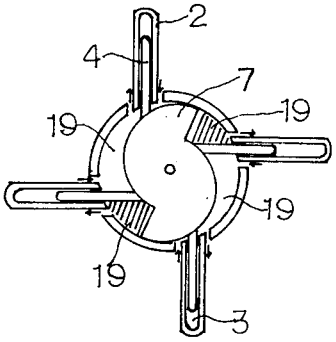
FIG. 6 is a plan view of the present compressor cylinder showing "S" wing shaft to the inleting stroke of the air chamber.

Referring to FIG. 1 and FIG. 6, the present invention comprises a sealed cylinder 1 which is hollow inside, the perimeter of which is fixed some equiangular convex pillar plate 2 (the small size compressor with 4 sets convex pillar plate, the large size compressor with 8, 9, and 10 . . . sets convex pillar plate). The slider 4 is fixed in the socket 3, channeling the internal section of convex pillar plate 2 and internal wall of cylinder 1. The slider 4 is provided with an arm extension 17 on its upper and lower parts and some pulleys 21 are provided with between the arm extension 17 and slider 4 in order to let it slide on sealed fixing plate 8. Further, the internal upper and lower end of the slider 4 is provided with a pillar 17' being secured to upper and lower pulleys 15, respectively. The pulley 15 is secured to the track 10 of "S" socket fixed at the bottom of the star disc cam 9 on the upper cover. Moreover, the external shell of sealed cylinder is provided with the inlet 12 and outlet 13. The inlet stroke is constructed with the free valve and except the moment the air sideswipes the point of "S" wing shaft in cylinder 1, the air can be inleted into the compressing chamber 19. The outlet stroke is constructed with the reverse valve and the air compressed into the compressing chamber 19 is outleted from outlet 13 with reverse valve under excluding by "S" wing shaft 7, and the retardation of the slider attached closely to "S" wing shaft. When the point of the "S" wing shaft 7 sends the slider 4 to socket 3 of the convex pillar plate 2, entirely the whole strock of the compressing chamber is completed and the air is completely exhausted from reverse valve 13. For the second compressing chamber, it is the beginner to exhaust continuously the inleted air from the separate set outlets beside the slider.

Figure 2:
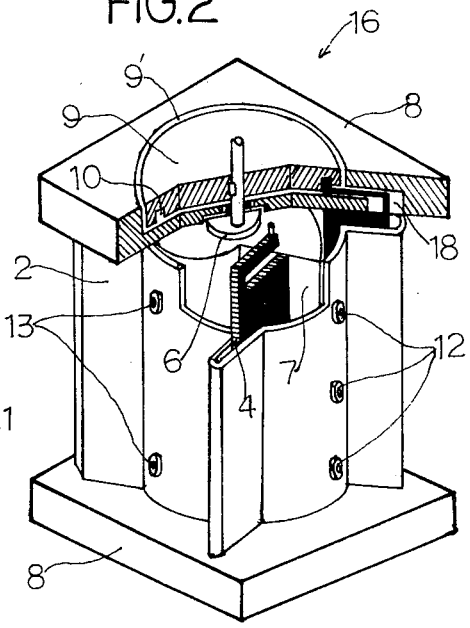
FIG. 2 shows a perspective view, partially broken away, of a compressor constructed in accordance with and embodying the present invention.

Referring to FIG. 1 and FIG. 2, the present invention is a compressor operated by motor starts the middle shaft 5 to make the "S" wing shaft 7 in the sealed cylinder 1 rotate and exclude the air inleted from the inlet 12 with free valve to the outlet 13 with reverse valve. (The compressing chamber exhausts the air from the outlet 13 by means of the rotation of "S" wing shaft 7 and gradual reduction of space by slider 4 sliding along "S" shaft 7.) The compressor is characterized by its two similar and symmetrical upper and lower sealed plates 8 comprising the enlaved star disc cam 9 and two sets of upper and lower "S" sockets 10. The slider 4 of the present invention compressor works under the track function of "S" socket 10 at the bottom of upper and lower star cams 9, which starts the pulley to reciprocate along socket 10. The present inventive compressor comprises three "S" components; the "S" wing shaft 7 and two "S" socket tracks 10 at the bottoms of upper and lower star disc. The present inventive compressor is characterized by its low-noise and saving of energy in 60%. The principle of saving energy of the present invention includes: (1) The sliding of slider 4 and pulley 15 of the present invention is characterized by its high speed and simple operation in comparison with the traditional gro-compressor. (2) The "S" wing shaft in cylinder functions as two compressing valves and make "S" wing shaft operation simple under the principle of couple. (3) The present inventive compressor provides the exhausting pressure with lesser energy by taking advantage of the fact that the inlet avails itself of more absorbing power than that of the outlet. (The small size compressor comprises four compressing chambers with three inlets and two outlets each, totalling 12 inlets and 8 outlets).

I claim:

1. A multipurpose, synchronous, three angle-cross compressor which comprises two spaced apart, flat end plates, each said end plate including a blind cylindrical bore which extends from its outer side which is opposite the side facing the other end plate towards its inner side, each end plate also including a hole which extends from the center point at the bottom of the blind cylindrical bore therein to its inner side, as well as at least four slots which extend in non-radial fashion away from the wall of the blind cylindrical bore, each slot including a connector portion which extends through to the inner side of the respective end plate, and all the slots in each end plate being equally spaced from one another, a generally cylindrical housing which extends between the two spaced apart, flat end plates, said housing including a hollow cylindrical body and at least four flanges which extend outwardly of the body in a non-radial fashion, the number and orientation of the flanges corresponding with the number and orientation of the slots in said end plates, each flange including a slideway which communicates with the interior of the hollow cylindrical body, an elongated S-shaped wing shaft located within the hollow cylindrical body of said housing so as to be rotatable therein, said S-shaped wing shaft including a central bore therethrough, a mounting shaft which extends through the central bore in said S-shaped wing shaft and through the support holes in said end plates, said mounting shaft being fixedly connected to said S-shaped wing shaft and of sufficient length to extend beyond the outer sides of said two end plates, two disc cams, each said disc cam being dimensioned to rotatably fit within the blind cylindrical bore in a respective said end plate, each said disc cam including an S-shaped track groove in the side thereof facing the bottom of the respective blind bore in which it is located, and each disc cam including a central hole therethrough through which said mounting shaft extends, each said disc cam being fixedly attached to the mounting shaft such that the orientation of the S-shaped track groove therein corresponds with the orientation of said S-shaped wing shaft, and at least four slider devices, each said slider device fitting within a respective flange of said housing and movable in and out of the interior of the hollow cylindrical body based on the degree of rotation of said disc cams, each said slider device comprising a rectangular member and two extension members, the two extension members comprising first arm portions which extend away from corresponding ends of the opposite short sides of the rectangular member, second arm portions which extend towards the opposite ends of the short sides of the rectangular member and in parallel with the short sides of the rectangular member, and third arm portions which extend away from the opposite ends of the short sides of the rectangular member, the first arm portions of each extension member fitting within a respective connector portion of a slot in the respective end plate and the third arm portions of each extension member fitting with a respective S-shaped track groove in a respective disc cam, and wherein the cylindrical body of said generally cylindrical housing includes two sets of compressed air inlet openings and two sets of air outlet openings.

2. The multipurpose synchronous, three angle-cross compressor as defined in claim 1 wherein the opposite short sides of the rectangular member of each said slider device includes slide bearings thereon, wherein the second arm portion of each extension member includes slide bearings on the side facing the associated rectangular member, and wherein the third arm portion of each extension member includes a slide bearing.

3. The multipurpose, synchronous, three angle-cross compressor as defined in claim 1 wherein each set of compressed air inlet openings comprises three aligned openings located along the longitudinal dimension of the cylindrical body, and wherein each set of air outlet openings comprises two aligned openings located along the longitudinal dimension of the cylindrical body.

* * * * *